US007749600B1

(12) United States Patent
Patrick et al.

(10) Patent No.: US 7,749,600 B1
(45) Date of Patent: Jul. 6, 2010

(54) MICROFIBER CORE MOP YARN AND METHOD FOR PRODUCING SAME

(75) Inventors: Gilbert Patrick, Kings Mountain, NC (US); Frank McNeely, Cherryville, NC (US)

(73) Assignee: Patrick Yarn Mills, Kings Mountain, NC (US)

( * ) Notice: Subject to any disclaimer, the term of this patent is extended or adjusted under 35 U.S.C. 154(b) by 633 days.

(21) Appl. No.: 11/538,274

(22) Filed: Oct. 3, 2006

Related U.S. Application Data

(60) Provisional application No. 60/726,129, filed on Oct. 13, 2005, provisional application No. 60/823,990, filed on Aug. 30, 2006.

(51) Int. Cl.
*D02G 3/00* (2006.01)

(52) U.S. Cl. ..... 428/357; 428/373

(58) Field of Classification Search ..... 428/357, 428/370, 373, 374; 57/200, 252
See application file for complete search history.

(56) References Cited

U.S. PATENT DOCUMENTS

| | | | | |
|---|---|---|---|---|
| 2,046,616 | A * | 7/1936 | Dreyfus | 57/200 |
| 3,959,556 | A | 5/1976 | Morrison | |
| 3,971,093 | A | 7/1976 | Komatsu et al. | |
| 4,038,813 | A | 8/1977 | Heap et al. | |
| 4,107,914 | A | 8/1978 | Van Dort | |
| 4,644,741 | A | 2/1987 | Gradinger et al. | |
| 5,398,492 | A | 3/1995 | Thomas | |
| 5,405,693 | A * | 4/1995 | Dittrich et al. | 428/355 AC |
| 5,405,698 | A * | 4/1995 | Dugan | 428/373 |
| 5,417,048 | A | 5/1995 | Thomas | |
| 5,567,796 | A * | 10/1996 | Nakatsukasa et al. | 528/272 |
| 5,579,628 | A | 12/1996 | Dunbar et al. | |
| 5,587,239 | A * | 12/1996 | Ueba et al. | 428/362 |
| 5,733,825 | A * | 3/1998 | Martin et al. | 442/361 |
| 5,804,274 | A | 9/1998 | Nordin | |
| 6,054,216 | A * | 4/2000 | Allen et al. | 428/373 |
| 6,131,233 | A | 10/2000 | Bolton et al. | |
| 6,254,988 | B1 * | 7/2001 | Zhu et al. | 428/373 |
| 6,465,095 | B1 | 10/2002 | Dugan | |
| 6,624,100 | B1 | 9/2003 | Pike | |
| 6,780,357 | B2 * | 8/2004 | Dugan et al. | 264/78 |
| 6,796,115 | B1 | 9/2004 | Patrick | |
| 6,829,881 | B1 * | 12/2004 | Manten | 57/243 |
| 2003/0062658 | A1 * | 4/2003 | Dugan et al. | 264/555 |
| 2003/0203695 | A1 * | 10/2003 | Polanco et al. | 442/365 |
| 2005/0044650 | A1 | 3/2005 | Goldberg et al. | |

OTHER PUBLICATIONS

Hatch, Textile Science, 1993 West Publishing Company, 1st Ed. p. 294.

* cited by examiner

*Primary Examiner*—N. Edwards
(74) *Attorney, Agent, or Firm*—Womble Carlyle Sandridge & Rice PLLC

(57) ABSTRACT

A mop yarn formed with a core of microdenier synthetic filament fibers wrapped with a sheath. The sheath generally includes carded staple fibers spun around the core.

20 Claims, 1 Drawing Sheet

MICROFIBER CORE MOP YARN AND METHOD FOR PRODUCING SAME

CROSS REFERENCE TO RELATED APPLICATION

The present application claims the benefit of U.S. Provisional Patent Applications Ser. Nos. 60/726,129, filed Oct. 13, 2005, and 60/823,990, filed Aug. 30, 2006, the disclosures of which are incorporated herein by reference in their entireties.

FIELD OF THE INVENTION

The present invention generally relates to the production of composite filament/fiber yarns, and in particular to the production of composite filament/spun staple mop yarns having a core formed from microdenier filaments or fibers and covered by a sheath of blended natural and manmade staple fibers.

BACKGROUND OF THE INVENTION

Historically, string mop yarns have been manufactured by spinning cotton wastes on an abbreviated version of a cotton spinning system. Over time, it was determined that the mopping properties of such cotton string mops could be enhanced by blending the cotton fibers with various synthetic and manmade fibers. Such cotton-synthetic fiber blends have included a blending of cotton fibers with acrylic, rayon, and/or polyester fibers. Such fibers generally are produced in deniers typically in the range of 1.5 denier per filament to 3.0 denier per filament for blending with the cotton fibers. Such cotton-synthetic fiber blends, when compared to 100% cotton mop yarns, were found to provide improved water absorbency with reduced break-in, reduced shrinkage, less linting on the floor, longer life, and faster drying of the mop yarns, whether the yarns were dried via air-drying or were dried in a commercial clothes drier.

More recently, 100% synthetic microfiber flat mops have become increasingly popular for light duty wet mopping versus the use of more traditional string yarn mops. These microfiber flat mops generally are made from extruded bundles of microfiber filament yarns that are knitted or tufted into a fabric scrim or fabric bundle, which then can be treated chemically to split the fabric bundle into wedge-shaped microdenier fibers. The fabric bundle of the split microfibers then further typically is combined with an absorbent pad or backing material and sewn into an elongated pad or carrier.

Such microfiber flat mops have been found to effective in light dusting, damp mopping, and disinfecting of smooth floors, with their use generally being most widespread in the healthcare industry and home use. However, these mops have been proven to be somewhat impractical for larger scale and/or heavier duty cleaning applications, due to the tendency of the fine denier continuous filaments to catch on surface protrusions and pull away and break from the parent strand, thus damaging the mop. As a result, many janitorial applications that involve the cleaning of larger, more highly soiled surfaces still must be cleaned by larger, traditional string yarn mops made from spun staple fibers. Examples of such janitorial applications include gymnasium floors, restaurants, public restrooms, schools, and buildings, which constitute a significant majority of the hard surface floors that require frequent cleaning in commercial buildings. In addition, while microdenier filaments have been found to efficient at channeling water, they generally are inefficient at absorbing water and thus tend to leave water streaks on clean surfaces. Such limited uses and disadvantages inherent in microfilament mop yarns, as well as their significantly higher cost versus even the highest quality spun stable fiber blended mop yarns, has tended to render such microdenier fibers impractical for most widespread cleaning applications.

Attempts also have been made to combine microfibers with spun yarns, such as by twisting strands of microdenier filament yarns with strands of yarns spun from staple fibers. For example, a yarn has been marketed that contains two plies of microdenier filament yarns and two plies of spun yarns twisted together. While this would appear to be an improvement over the problems inherent in the 100% filament mop yarn approach, the same problems of snagging, splitting, and streaking have been experienced. Thus, there remains a need for a commercial mop yarn for commercial cleaning applications, such as in the healthcare industry, that will not shrink significantly and can be rapidly dried, and which further can hold up to frequent laundering, being subjected to as many as one hundred laundry cycles during its lifetime.

DETAILED DESCRIPTION OF THE INVENTION

Figure 1:
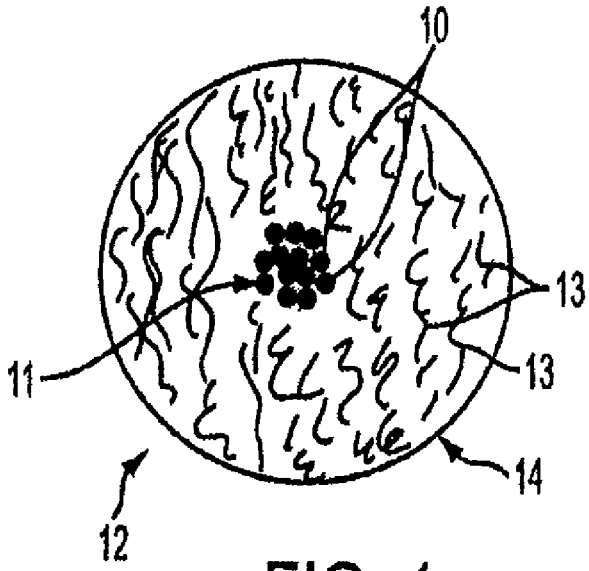
FIG. 1 is an end view of the microdenier filament core mop yarn according to one embodiment of the present invention.
Figure 2:
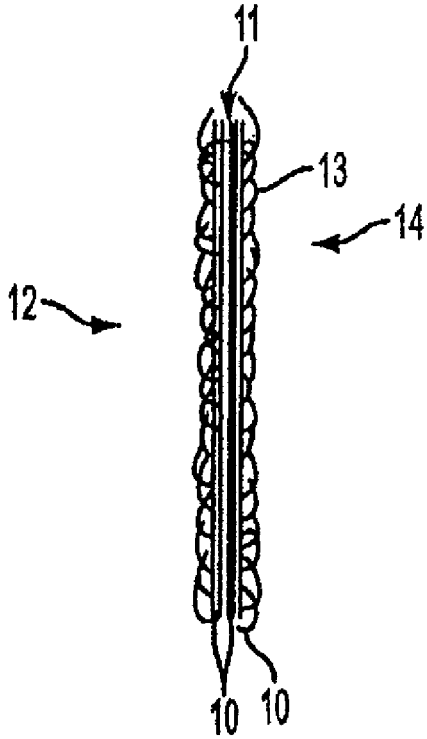
FIG. 2 is a side view illustrating the microdenier filament core and sheath of staple fibers of the microdenier filament core mop yarn according to one embodiment of the present invention.

Per the invention being presented, as illustrated in FIGS. 1-2, a series of microdenier filaments 10 are specially prepared into a larger denier mop yarn that is heat-stabilized for shrink resistance. This yarn can include a yarn prepared as disclosed in U.S. patent application Ser. No. 11/347,528, filed Feb. 3, 2006, which application is incorporated by reference, as if fully set forth in the present application. This yarn is fed into a friction spinning machine (Dref) as the core 12 of an engineered microdenier yarn filament structure. Carded slivers of blended staple fibers 13 similar to conventional blended mop yarns then generally are formed into a sheath 14 that substantially completely covers the microdenier filament core 12 such as illustrated in FIG. 1. The resultant composite yarn 11 has a microdenier filament core 12 covered by a sheath of blended staple fibers 13.

In one example preferred embodiment, a microdenier filament yarn must first be prepared to serve as the core of the composite structure. The microdenier filament yarn typically can be composed of PET polyester polymer but could be nylon, PTT, polyolefin, or polyethylene or any other synthetic filaments extruded, drawn and finished to a denier per filament of less than 1.00 dpf. Multiple strands of the yarn are then combined and air textured, and are air entangled to form a multi-filament yarn in the total denier size needed or desired for the particular performance and economic levels selected or desired. For the present invention, the filaments are combined to approximately 1000 to 2000 total yarn denier, although other sizes also can be prepared depending on the application or use for the finished yarn. The yarn typically is then heat set and a "dry" hydroscopic spin finish is applied, and the yarn packaged on parallel tubes.

The staple fibers for the outer spun sheath can include cotton, acrylic, rayon, polyester and other, similar staple fibers having similar absorption and cleaning properties, in denier ranges from about 1.0 dpf to about 3.0 dpf and in staple lengths in a range of approximately 1.5"-2.0". Any blend of synthetic or natural fibers could be used within the sheath of the yarn mass, bringing the unique properties of the different fibers to the finished product. For example, para-aramid fibers could be incorporated within the sheath fibers to bring an increased level of cut protection to the finished product, while adding meta-aramid fibers can also be done to provide heat resistance/protection.

The fibers are measured and blended at the opening process by means of electronic or mechanical weighing. This can be done by either a weigh pan system incorporating individual hoppers that weigh and drop different fiber types onto a moving conveyor belt, or by an automated bale feeder and blender that automatically removes the fibers from an opened bale and weighs the fibers on a moving conveyor belt, adjusting the speeds accordingly to insure the correct blend levels. The fibers then are "opened up" or made into small fiber tufts and processed through several mixers to insure all components are evenly dispersed within the fiber mass. The mixed fiber mass is then stored/transferred in a large reserve such as a Fiber Control 99 Reserve, being tumbled within the bin as the fibers thereafter are fed to the cards of a downstream carding system, thus helping to evenly intermix the different fibers.

The fibers are fed into the carding process through enclosed ductwork and are deposited into a chute that prepares a fibrous mat for feeding/depositing into the carding machine. The present invention generally will utilize modern carding technology such as a Crosrol Mark 5 Tandem, Crosrol CST, or Truzschuler 803 or 903 Carding System. However, any model card in good condition would be capable of producing a desirable continuous fiber strand called a sliver. The strands or silver also may be processed through an additional drawing stage if one so desires for more evenness in sliver weight or uniformity in color.

After the initial carding operation, the strands then can be fed into the back of a Dref spinning machine. The present invention generally utilizes a Dref 2, but a Dref 2000, Dref 3000, or Dref 3 is capable of producing the desired yarns depending upon the yarn size and the fiber lengths utilized. It is also conceivable to manufacture the present invention on ring, air jet, open-end or worsted spinning systems. Several fiber strands typically are fed together to compose a total weight yarn of about 220-400 grains. As the fibers enter the Dref spinning machine, a carding drum covered with saw toothed teeth reopen or individualize the fibers and propel them between two perforated drums. The perforated drums are rotated in the same direction and at a predetermined rate, with an adjustable negative vacuum being applied at the junction or nip between the drums, where the fibers are transferred from one carding drum to the other carding drum.

The microdenier filament(s) then is fed from a discharge end of the rotating drums and is pulled through the spinning zone by an outlet roller. As the filament passes through this spinning zone, the individualized fibers 13 are rotated or spun around the filament(s) 10 to form a staple fiber sheath 14 substantially completely covering the core to a desired percentage as indicated in FIGS. 1 and 2. The number of strands of the carded sliver, the weight per unit length, and the denier of the resultant filament core yarn 11 generally are varied to determine the percentage of microdenier filament(s) 10 in the overall composite structure to achieve/incorporate the desired performance characteristics. For example, a level in the range of 15%-20% microdenier filaments has been determined to give optimum cleaning, abrasion, and drying performance.

It is also envisioned that a sliver of stretch-broken or staple spun microdenier fibers also could be spun in the core of the yarn, replacing or accompanying the microdenier filaments by utilizing the Dref 3 or Dref 3000 technology. This embodiment does bring enhanced properties to the standard mop yarns currently used, but not to the elevated properties of the present invention.

The finished, sheathed, yarns 11 can be used individually, but are usually plied with other alike yarns or different yarns bringing unique properties or economies, to form a twisted, plied yarn. This process helps balance the yarn whereas it does not want to twist upon itself and also increases the total yarn mass to a desirable size and weight. The present invention also can utilize multiple (i.e., three, four, or more) plies of the single yarn containing a microdenier filament core. These plies generally will be twisted in a rotational direction opposite that employed in spinning to nullify the torque effect resulting in a substantially torque free yarn.

For wet floor mopping, the subject yarns have demonstrated the following enhanced properties:

Enhanced wet pick up without increasing the % release during wringing
Negligible shrinkage of approximately 10%
Reduced or eliminated break-in time
Faster drying
Increased bulk
Increased strength and resistance to abrasion Trials/Testing:

The trials represented herein are only examples of applications in wet mops.

The following micro fiber/staple fiber yarn blend was prepared which is typical of a premium blend commonly used in healthcare:

31% Cotton
36% Rayon
8% Polyester
25% Acrylic Producer Dyed Gold

A 1500 denier/1500 filament microfiber polyester yarn was prepared as described previously. The staple fiber blend was carded into slivers that were spun on a Dref 2 as previously described and plied to a 0.47/4 Ne. yarn count. This was tested in comparison with a yarn having a composition blend similar to the sheath fibers, and which was spun on a Rieter RL10 rotor machine (135 mm rotor) to a 0.60/4 Ne. yarn count.

The sample was tested according to the industry standard test method for commercial wet mops by immersing the sample in water for 30 seconds, letting it drip for 30 seconds, then weighing the sample. The sample was then wrung in a commercial wringer to a specified torque level and weighed again. The absorbency (x) is expressed as saturated weight divided by dry weight. Percent release is saturated weight minus wrung weight divided by saturated weight. Working weight is wrung-out weight divided by dry weight (please note that all weights listed in the following tables are in "grains," where one pound=7,000 grains).

| | Dry Weight | Saturated Weight | Wrung Weight at 60 lb-ft. | Absorbency X | Percent Release | Working X |
|---|---|---|---|---|---|---|
| Control Sample | 7568 | 31374 | 24943 | 4.1 | 20% | 3.3 |
| Test Sample | 7603 | 36680 | 28422 | 4.8 | 23% | 3.7 |

This represents a 17% improvement in absorbency and 12% in working weight. In commercial mopping applications, this level of improvement has been found to offer a demonstrable effect on cleaning efficacy. These improvements would be observed in the form of fewer wringing cycles required per area of floor cleaned, a heavier mop after wringing that requires fewer strokes to achieve the same level of cleanliness, and better floor drying due to greater pick-up, requiring less wringing cycles. Subjective mopping comparisons on test floors for these samples confirmed these expected improvements.

It was observed that the test yarn also appeared to have more bulk/volume than the control sample. This was confirmed by measuring the outside diameter of two skeins of yarn weighing the same. The test sample measured 198 mm in diameter vs. 162 mm for the control sample, an increase of 22% in volume/bulk of the sample yarn. In addition, the thickness of the yarn was measured on an Ames model 90-283 Comparator Gage Tester fitted with a six gram weight. The thickness of the test sample, when factored for the heavier yarn count, was 0.133" vs. 0.125" for the control sample. This is only a 7% increase in thickness; however, the nature of this test with a weight pressing down upon the yarn tends to remove much of the yarn bulk as part of the measurement process.

The yarn samples were then subjected to five identical wash/dry cycles under the following conditions:

Washer: Whirlpool Duet front loader model GHW 9200LW. Quick wash 40-minute cycle with ¼ cup of Tide laundry detergent. Water temperature—warm/warm=104° F. Low spin speed.

Dryer: Whirlpool Duet front loader model GEW 9200LW. 60 minute timed cycle. High temperature=165° F.

| | Original Length | Length after First Washing | Percentage Shrinkage |
|---|---|---|---|
| Control Sample | 26" | 18.5" | 29% |
| Test Sample | 26" | 23.5" | 10% |

| | Time to Dry | Percentage to Test Sample |
|---|---|---|
| Control Sample | 150 minutes | 214% |
| Test Sample | 70 minutes | — |

As one can see in the above test data the present invention produces a yarn that absorbs and releases moisture faster than conventional spun yarns. It has improved strength and incurs less shrinkage after laundering. Strength and resistance to abrasion are further enhanced, making the yarns particularly suited for cleaning applications such as in Fast food restaurants that increasingly utilize highly abrasive floor surfaces to reduce the incidence of employees and customers slipping and falling. Such abrasive surfaces cause mops to abrade rapidly, with the mop strands often breaking at the juncture of the head band within a few days of use. The mops also will leave excessive amounts of lint on the floor, which usually requires sweeping after the floor has dried. Mops constructed from the above described microdenier filament core test sample yarn were placed in national chain restaurant known for having the most abrasive/aggressive floors in the industry. These mops were removed after a full three weeks of use with no broken strands. It was also observed that the floor required little or no sweeping after wet mopping.

All tests were performed using the yarn described by the present invention assembled in the formation of a mop. One skilled in the art also can see, however, that this technology could be desirable in other fibrous products having knitted or woven configuration whereas the detailed improvements bring added value and performance to the finished product.

It will be further understood by those skilled in the art that while the present invention has been described above with reference to preferred embodiments, numerous variations, modifications, and additions can be made thereto without departing from the spirit and scope of the present invention as set forth in the following claims.

What is claimed is:

1. A spun yarn comprising a plurality of microdenier synthetic filaments of less than 1.0 denier per filament, said microdenier synthetic filaments forming a yarn core constituting approximately 2% to approximately 90% of total mass of the yarn, and a sheath covering said core and comprising a series of carded textile staple fibers spun as a sheath around and covering said core.

2. The yarn of claim 1, wherein said microdenier synthetic filaments of said yarn core are selected from the group comprising PET, PTT, nylon, polypropylene, polyethylene, aramids, bi-components, and blends thereof.

3. The yarn of claim 1, and wherein said staple fibers of said sheath are selected from natural fibers, man-made fibers, and blends thereof.

4. The yarn of claim 1, and wherein said sheath further comprises a series of staple spun microfibers mixed with said staple fibers.

5. The yarn of claim 1 wherein the yarn is spun on a-friction spinning machine.

6. The yarn of claim 1 formed by ring spinning.

7. The yarn of claim 1 formed by air jet spinning.

8. The yarn of claim 1 formed by open-end spinning.

9. The yarn of claim 1 formed on a worsted spinning system.

10. A yarn comprising a core of a plurality of microdenier staple synthetic filaments of less than 1.0 denier per filament, the core constituting about 2% to about 90% total mass of the yarn, and a sheath comprising a series of carded textile staple fibers having deniers of about 1.0 denier per filament to approximately 3.0 denier per filament spun around and covering said core.

11. The yarn of claim 10, wherein the microdenier staple synthetic filaments of the core are selected from the group comprising PET, PTT, nylon, polypropylene, polyethylene, aramids, bi-components and blends thereof.

12. The yarn of claim 11 and wherein said staple fibers of said sheath comprise natural fibers, man-made fibers or blends thereof.

13. The yarn of claim 10 and further comprising a plurality of microfibers combined with said staple fibers to form said sheath.

14. The yarn of claim 10 spun on a friction spinning frame.

15. The yarn of claim 10 spun by ring spinning.

16. The yarn of claim 10 spun by air jet spinning.

17. The yarn of claim 10 spun by open-end spinning.

18. The yarn of claim 10 spun on a worsted spinning system.

19. The yarn of claim 1 and wherein said staple fibers comprise deniers in a range of about 1.0 denier per filament to about 3.0 denier per filament.

20. The yarn of claim 1 and wherein said staple fibers comprise staple fiber lengths in a range of about 1.5 inches to about 2.0 inches.

* * * * *